US007938913B2

(12) United States Patent
Berner et al.

(10) Patent No.: US 7,938,913 B2
(45) **Date of Patent: *May 10, 2011**

(54) CONVEYOR DISHWASHER AND OPERATING METHOD FOR SAME

(75) Inventors: Dietrich Berner, Waldstetten (DE); Klaus Padtberg, Offenburg (DE); Harald Disch, Elzach (DE); Jürgen Litterst, Appenweier (DE)

(73) Assignee: Premark FEG L.L.C., Wilmington, DE (US)

( * ) Notice: Subject to any disclaimer, the term of this patent is extended or adjusted under 35 U.S.C. 154(b) by 1092 days.

This patent is subject to a terminal disclaimer.

(21) Appl. No.: 11/494,340

(22) Filed: Jul. 27, 2006

(65) Prior Publication Data

US 2007/0023069 A1 Feb. 1, 2007

(30) Foreign Application Priority Data

Jul. 29, 2005 (DE) ..... 10 2005 035 764

(51) Int. Cl.
*B08B 3/00* (2006.01)

(52) U.S. Cl. ..... 134/56 D; 134/58 D; 134/124; 134/131

(58) Field of Classification Search ..... None
See application file for complete search history.

(56) References Cited

U.S. PATENT DOCUMENTS

| | | | | |
|---|---|---|---|---|
| 1,730,348 | A | | 10/1929 | Anstiss |
| 2,235,885 | A | | 3/1941 | Johnson |
| 2,270,595 | A | | 1/1942 | Lewis |
| 3,504,390 | A | | 4/1970 | Wing |
| 3,598,131 | A | | 8/1971 | Weihe, Jr. |
| 3,739,790 | A | | 6/1973 | Gudz et al. |
| 3,789,860 | A | | 2/1974 | Katterheinrich et al. |
| 3,896,827 | A | * | 7/1975 | Robinson ..... 134/10 |
| 3,900,040 | A | | 8/1975 | Graber et al. |
| 4,066,472 | A | | 1/1978 | Perry |
| 4,070,204 | A | | 1/1978 | Hardy et al. |
| 4,231,806 | A | | 11/1980 | Henry |
| 4,313,451 | A | | 2/1982 | Vilen |
| 4,509,543 | A | * | 4/1985 | Livingston et al. ..... 134/57 D |
| 4,532,983 | A | | 8/1985 | Bradshaw et al. |
| 4,561,904 | A | | 12/1985 | Eberhardt, Jr. |
| 4,788,992 | A | | 12/1988 | Swainbank et al. |
| 5,259,889 | A | | 11/1993 | Payzant |
| 5,267,580 | A | * | 12/1993 | Payzant ..... 134/57 D |
| 5,497,798 | A | | 3/1996 | Fritz et al. |

(Continued)

FOREIGN PATENT DOCUMENTS

DE 1428349 11/1968

(Continued)

OTHER PUBLICATIONS

Non-Final Office Action; Feb. 1, 2010; U.S. Appl. No. 11/570,697; 18 pages.

(Continued)

*Primary Examiner* — Michael Kornakov
*Assistant Examiner* — Eric Golightly
(74) *Attorney, Agent, or Firm* — Thompson Hine LLP

(57) ABSTRACT

A conveyor dishwasher includes a storage tank for holding sprayed final rinse liquid and a controllable liquid transfer device for transferring liquid from the storage tank to at least one wash zone as a function of a liquid demand in at least one of the wash zones.

15 Claims, 1 Drawing Sheet

U.S. PATENT DOCUMENTS

| | | | | |
|---|---|---|---|---|
| 5,800,628 | A * | 9/1998 | Erickson et al. | 134/18 |
| 5,846,339 | A | 12/1998 | Masshoff et al. | |
| 5,993,739 | A * | 11/1999 | Lyon | 422/31 |
| 6,354,481 | B1 | 3/2002 | Rich et al. | |
| 6,530,996 | B2 * | 3/2003 | Varpio | 134/18 |
| 6,536,060 | B1 * | 3/2003 | Janssens et al. | 8/159 |
| 6,632,291 | B2 | 10/2003 | Rabon et al. | |
| 7,481,231 | B2 * | 1/2009 | Litterst et al. | 134/60 |
| 2002/0096192 | A1 | 7/2002 | Reichold | |
| 2003/0019510 | A1 * | 1/2003 | Hegeman et al. | 134/18 |
| 2003/0110815 | A1 | 6/2003 | Poy | |
| 2004/0182116 | A1 * | 9/2004 | Czyzewski et al. | 68/12.02 |
| 2008/0035175 | A1 * | 2/2008 | Varacins et al. | 134/18 |

FOREIGN PATENT DOCUMENTS

| | | |
|---|---|---|
| DE | 1628813 | 7/1970 |
| DE | 116338 | 11/1975 |
| DE | 2607813 | 9/1977 |
| DE | 2712020 | 9/1978 |
| DE | 2736088 | 2/1979 |
| DE | 3419423 | 11/1984 |
| DE | 3441222 | 5/1986 |
| DE | 3707366 | 3/1987 |
| DE | 3922067 | 1/1991 |
| DE | 3938755 | 5/1991 |
| DE | 4311064 | 10/1994 |
| DE | 4437737 | 4/1996 |
| DE | 29622760 | 7/1997 |
| DE | 19644438 | 4/1998 |
| DE | 19704989 | 8/1998 |
| DE | 19829650 | 1/2000 |
| DE | 20220465 | 8/2003 |
| EP | 0022307 | 1/1981 |
| EP | 0678275 | 10/1995 |
| EP | 0838190 | 4/1998 |
| EP | 0980668 | 2/2000 |
| EP | 0980669 | 2/2000 |
| EP | 0980670 | 2/2000 |
| EP | 1042983 | 10/2000 |
| GB | 2243285 | 10/1991 |
| JP | 04-327119 | 11/1992 |
| JP | 05-269073 | 10/1993 |
| JP | 06-245890 | 9/1994 |
| JP | 08-056884 | 3/1996 |
| JP | 09-248270 | 9/1997 |
| JP | 11-056735 | 3/1999 |
| JP | 2001-346747 | 12/2001 |
| WO | WO 83/01187 | 4/1983 |
| WO | WO 2004/018143 | 3/2004 |

OTHER PUBLICATIONS

International Search Report issued Feb. 6, 2006, regarding PCT/US2005-018895 Feb. 6, 2006.

* cited by examiner

CONVEYOR DISHWASHER AND OPERATING METHOD FOR SAME

TECHNICAL FIELD

The invention relates to a conveyor dishwasher and an operating method for same.

BACKGROUND

Conveyor dishwashers (such as a belt conveyor dishwashing machine or flight-type dishwasher) are used in the commercial area. An exemplary conveyor dishwasher is known from European Patent 0 838 190 B1. In contrast with household dishwashers in which the wash ware to be cleaned remains stationary in the machine during the cleaning process with conveyor type dishwashers the wash ware is conveyed through various zones of the conveyor dishwasher. Each zone is provided with a tank which holds the liquid sprayed in the respective zone. The conveyor dishwasher includes in particular at least one zone designed as a wash zone in which the wash ware is cleaned to remove impurities, e.g., food residues.

With known conveyor dishwashers, two factors often contribute to the total water consumption: first, the initial filling of the conveyor dishwasher in which fresh water is added to the tank of the at least one wash zone and, secondly, the final rinse during operation of the conveyor dishwasher. The final rinse liquid supplied for the final rinse runs according to the cascade principle through the entire machine. The water is kept fresh in the tanks, i.e., the concentration of impurities is kept low by constant dilution. Another effect of this supply of liquid into the tanks is that exactly as much liquid is displaced out of the tanks, i.e., enters the drain, as is supplied to the tanks.

SUMMARY

In an aspect, a conveyor dishwasher for cleaning wash wares includes a conveyor device for conveying the wash wares in a direction of conveyance through at least two zones of the conveyor dishwasher, at least one zone of which is a wash zone having spray nozzles. A tank and a pumping device are provided for recirculating wash liquid from the tank to the spray nozzles and spraying the wash liquid through the spray nozzles onto the wash wares. At least one zone is a final rinse zone including spray nozzles for spraying final rinse liquid onto the wash wares. A storage tank gathers sprayed final rinse liquid and a liquid transfer device is used for transferring liquid from the storage tank to the wash zone, which thereby forms a target zone. A control unit is configured for automatic operation of the liquid transfer device depending on the liquid demand in the wash zone.

In another aspect, a method for operating a conveyor dishwasher is provided. The method includes providing the conveyor dishwasher with a final rinse zone for spraying final rinse liquid onto the wash ware and a wash zone for spraying wash liquid onto the wash ware. Wash liquid is sprayed onto the wash ware in the wash zone. Final rinse liquid is sprayed onto the wash ware. The final rinse liquid is collected in a storage tank. The final rinse liquid is supplied to the wash zone as a function of demand for liquid.

Advantageously, a supply of final rinse liquid may be available in the storage tank, the tank may be filled with the final rinse liquid from the storage tank when liquid is entrained. This can reduce fresh water consumption.

The initial filling of the conveyor dishwasher may be performed using final rinse liquid from the storage tank. This can reduce the demand for fresh water.

This invention is explained in greater detail below with reference to the drawings on the basis of preferred embodiments as examples. The definitions and explanations given above also apply to the following description of the drawings and vice-versa.

DETAILED DESCRPTION

Figure 1:
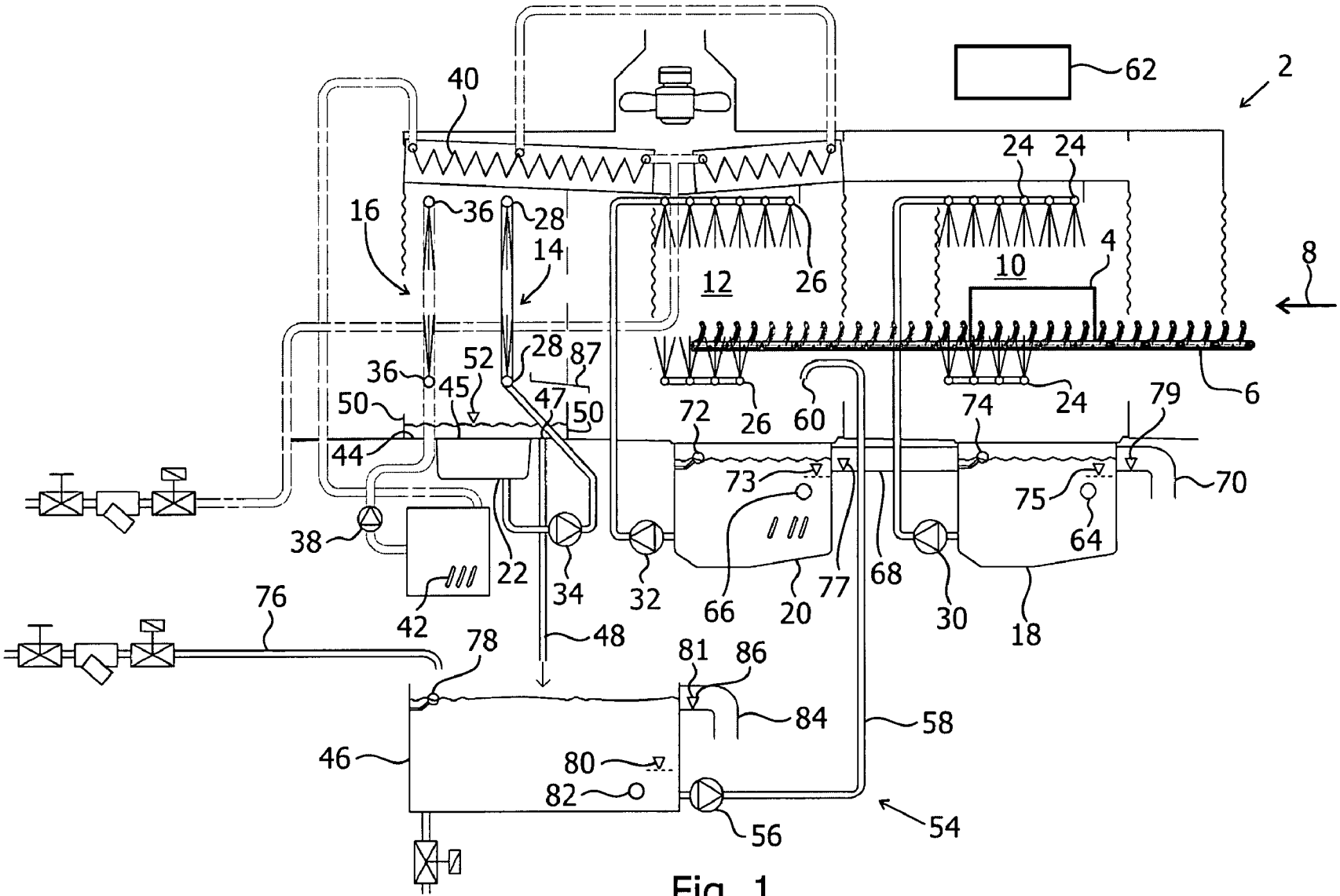
FIG. 1 an embodiment of a conveyor dishwasher according to this invention.

The conveyor dishwasher 2 shown in FIG. 1 for washing wash ware 4 contains a conveyor device 6 for conveying the wash ware 4 in a direction 8 of conveyance through at least two zones of the conveyor dishwasher 2. In the embodiment shown here, the conveyor device 6 is a belt-type conveyor device. As an alternative, the conveyor device 6 may be a rack conveyor device.

The term "wash ware 4" includes, as examples, dishes, glasses, cutlery, pots, containers, boxes, trays, etc. The term "cleaning" includes, as examples, pre-wash, wash, post-wash, final rinse, etc. The term "washing" refers to cleaning the wash ware 4 with the wash liquid to remove impurities from the wash ware 4. The term "final rinse" refers to the treatment of the wash ware 4 with final rinse liquid to remove wash liquid in particular from the wash ware 4. Final rinse liquid may be, for example, pure water or water to which a rinse aid has been added.

The conveyor dishwasher 2 illustrated in FIG. 1 includes a front wash zone 10, as seen in the direction 8 of conveyance of the wash ware 4, a rear wash zone 12, a post-wash zone 14 and a final rinse zone 16. The post-wash zone 14 is also referred to as the pre-rinse zone. The front wash zone 10, the rear wash zone 12 and the post-wash zone 14 each have a tank 18, 20, 22, spray nozzles 24, 26, 28 and a pump mechanism 30, 32, 34 for recirculating liquid from the respective tank 18, 20, 22 to the spray nozzles 24, 26, 28 of the respective zone 10, 12, 14 and thereby spraying the liquid out of the respective tank 18, 20, 22 onto the wash ware 4. The final rinse liquid is preferably used for the first time in the final rinse zone 16. In the post-wash zone 14, final rinse liquid that has already been used is reused as post-wash liquid. In one embodiment, it is recirculated.

The final rinse zone 16 has spray nozzles 36 for spraying final rinse liquid onto the wash ware 4. The final rinse liquid may be conveyed by a pump mechanism 38 to the spray nozzles 36, as depicted here, for example, or it may be conveyed through corresponding line pressure in the final rinse liquid line. A heat exchanger 40 and a heating device 42, preferably a water heater, are provided for heating the final rinse liquid.

The final rinse liquid discharged from the final rinse nozzles 36 may be fresh water, for example or fresh water mixed with rinse aid.

The conveyor dishwasher 2 has a bottom part 44 where the sprayed final rinse liquid collects. In the embodiment illustrated here, the bottom area 44 includes an area of the final rinse zone 16 and the post-wash zone 14. A tank opening 45 may be formed in the bottom area 44 opening into the tank 22 of the post-wash zone 14, as illustrated in FIG. 1. In this way final rinse liquid sprayed by the spray nozzles 36 enters the tank 22 of the post-wash zone 14. In this sense, the tank 22 of the post-wash zone 14 is a shared tank which is provided for both the final rinse zone 16 and also the post-wash zone 14. The final rinse liquid sprayed by the spray nozzles 36 of the final rinse zone 16 is recirculated by the pump mechanism 34 to the spray nozzles 28 of the post-wash zone 14.

According to this invention the conveyor dishwasher has a storage tank 46 to hold sprayed final rinse liquid. "Sprayed final rinse liquid" as used herein may be final rinse liquid sprayed by the spray nozzles 36 of the final rinse zone 16 or post-wash liquid sprayed by the spray nozzles 28 of the post-wash zone 14. Post-wash liquid is final rinse liquid that has already been used. In any case, "sprayed final rinse liquid" refers to a liquid to which no detergent has been added in order to maintain a predetermined detergent concentration in the final rinse liquid, as is the case with the wash liquid in wash tanks 18, 20. Of course, the final rinse liquid sprayed onto the wash ware 4 and running off of the wash ware 4 contains a nonspecific detergent concentration, but it is lower than the detergent concentration in the wash tanks.

In general, at least one zone in which final rinse liquid is sprayed is connected by fluid flow to the storage tank 46. For example, the final rinse zone 16 may be connected to the storage tank 46 by flow in such a way that sprayed final rinse liquid enters the storage tank 46. Furthermore, the post-wash zone 14 may be connected by flow to the storage tank 46 in any desired manner so that sprayed final rinse liquid enters the storage tank 46.

In the embodiment depicted here, the bottom part 44 has a storage tank opening 47 in the area of the post-wash zone 14, said opening being connected by flow to the storage tank 46, namely by a line 48 here. As an alternative to the embodiment depicted here, the line 48 may be connected to the bottom part 44 in the area of the final rinse zone. Furthermore, the line 48 may be connected to the tank 22 of the post-wash zone 14.

In the depicted embodiment, zone walls 50 are provided, bordering the bottom part 44 at the side and permitting a liquid level 52 above the tank opening 45 and above the storage tank opening 47 so that liquid can flow out of the tank 22 and into the storage tank opening 44 and then can flow out through the line 48 into the storage tank 46. This configuration permits adequate filling of the tank 22 with final rinse liquid on the one hand, while on the other hand also allowing final rinse liquid to automatically flow over into the storage tank 46 when the liquid level 52 is higher than the storage tank opening 47.

A controllable liquid transfer device 54 is provided having a pump mechanism 56 and a liquid line 58 for transferring liquid from the storage tank 46 to the rear wash zone 12, which thus forms a target zone. The liquid transfer device 54 may be formed by any other device which allows controlled transfer of liquid from the storage tank 46 into the at least one target zone.

The mouth 60 of the liquid transfer device 54 is preferably arranged with a distance in height above than tank 20 of the wash zone 12, as illustrated in FIG. 1. The conveyor dishwasher 2 also contains a control unit 62 which is designed for automatic operation of the liquid transfer device 54 as a function of a liquid demand in at least one of the wash zones 10, 12, e.g., as a function of a liquid demand in the rear wash zone 12 or in the front wash zone 10.

To determine a liquid demand in at least one of the wash zones 10, 12, a sensor device may be provided.

The front wash zone 10 includes a sensor device in the form of a turbidity sensor 64 for detecting a degree of soiling of the liquid in the tank 18 of the front wash zone 10. Furthermore, the rear wash zone 12 includes a sensor device in the form of a turbidity sensor 66 for detecting a degree of soiling of the liquid in the tank 20 of the rear wash zone 12. The control unit 62 is designed for operating the liquid transfer device 54 when the degree of soiling in the tank 20 of the rear wash zone 12 is above a predetermined degree of soiling. By operating the liquid transfer device 54, liquid from the storage tank 64 is supplied to the tank 20 of the rear wash zone 12 and thus the degree of soiling, i.e., the concentration of impurities in the tank 20 of the rear wash zone 12 is reduced.

The control unit 62 is also designed for operating the liquid transfer device 54 when the degree of soiling in the tank 18 of the front wash zone 10 exceeds a predetermined degree of soiling. The predetermined degree of soiling of the liquid in the tank 20 of the rear wash zone 12 may be equal to the predetermined degree of soiling of the liquid in the tank 18 of the front wash zone 12. Furthermore, the predetermined degree of soiling of the liquid in the tank 18 of the front wash zone 10 may be higher than the predetermined degree of soiling of the liquid in the tank 20 of the rear wash zone 12. In the case of a liquid demand in the tank 18 of the front wash zone 10 and operation of the liquid transfer device 54 on this basis, the liquid is supplied in the embodiment depicted here from the storage tank 46 to the tank 20 of the rear wash zone 12 from which liquid can flow via liquid overflow device 68, namely an overflow channel here, into the tank 18 of the front wash zone 10 to thereby reduce the concentration of impurities in the liquid in the tank 18. The liquid from the tank 20 of the rear wash zone 12 flows over the overflow channel 68 into the tank 18 of the front wash zone 10 when the liquid level in the tank 20 of the rear wash zone 12 is above the outflow level 77.

The tank 18 of the front wash zone 10 is equipped with an overflow 70 (drain) through which liquid can flow out of the tank 18. When the liquid in the tank 18 of the front wash zone is above an outflow level 79, liquid flows out of the tank 18 through the overflow 70. FIG. 1 illustrates such a situation, where the prevailing momentary liquid level in the tanks 18, 20 is above the prevailing outflow level 77, 79.

At least one of the sensor devices may also be designed in the form of a liquid level sensor for detecting a predetermined level of liquid in the tank of the respective at least one wash zone. In the embodiment depicted here, the rear wash zone 12 is provided with a level sensor 72 for detecting a predetermined lower level 73 of liquid in the tank 20 of the rear wash zone 12. Furthermore, the front wash zone 10 is provided with a liquid level sensor 74 for detecting a predetermined lower level 75 of the liquid in the tank 18 of the front wash zone 10. The predetermined lower level 73 of the rear wash zone 12 may be at the same height as the predetermined lower level 75 of the front wash zone 10. Furthermore, the predetermined lower level 73 of the rear wash zone 12 may be higher or alternatively lower than the predetermined lower level 75 of the front wash zone 10. The predetermined lower levels 73, 75 are preferably below the respective outflow level 77, 79 of the respective tank 20, 18. In the embodiment depicted here, the liquid level sensors 72, 74 are designed as level switches, where the predetermined lower level 73, 75 corresponds to the lower switch point of the respective liquid level switch 72, 74.

Liquid may be supplied out of the storage tank 46 into the respective target zone over a predetermined period of time, for example. Furthermore, liquid may be supplied from the storage tank 46 into the respective target zone until a predetermined upper level has been reached or exceeded in the target zone. The predetermined upper level may be for example the upper switch level of the liquid level switch 72, 74 in the respective wash zone 10, 12. The predetermined upper level of the respective wash tank may be at the same height as the outflow level 77, 79 of the respective wash tank, for example.

In particular, entrainment of liquid by large dishes from the rear zone 12 into the front zone 10 can be detected by means of the liquid level sensor 72 in the tank 20 of the rear zone 12 and the tank may be filled accordingly with liquid out of the storage tank 46. Such an entrainment of liquid in conveyor dishwashers occurs in particular with large wash ware whereby liquid entrainment occurs in the opposite direction from the direction of conveyance of the wash ware and consists of the fact that liquid which is sprayed onto the wash ware 4 in a downstream zone in the direction 8 of conveyance, flows into the preceding zone 10 on this wash ware 4.

There may also be a demand for liquid in the wash zones 10, 12 in the initial filling of the conveyor dishwasher 2. Accordingly, the control unit 62 is preferably designed for operating the liquid transfer device 54 in the initial filling of the conveyor dishwasher 2 to supply liquid from the storage tank 46 to at least one of the wash zones 10, 12, preferably both wash zones 10, 12. In this way, the fresh water demand of the conveyor dishwasher 2 can be reduced because no supply of fresh water is necessary for the initial filling of the wash tanks 18, 20 but instead the final rinse liquid generated in a previous cleaning operation of the conveyer dishwasher is reused for the initial filling of the wash tanks 10, 12.

To this end, the volume of the storage tank 46 maybe of such a dimension that it is at least equal to the sum of the individual tank volumes of the wash tanks 18, 20 of the wash zones 10, 12. Furthermore, depending on the available space, the volume of the storage tank 46 may be smaller than the sum of the individual tank volumes of the wash tanks 18, 20.

As FIG. 1 shows, a fresh water supply device 76 may be provided, so that fresh water can be supplied to the storage tank 46. In this case, preferably at least one sensor device is provided for determining a fresh water demand in the storage tank 46 and the control unit 62 is designed for operating the fresh water supply device 76 and therefore supplying fresh water to the storage tank 46 when there is a demand for fresh water in the storage tank 46.

A sensor device for determining a fresh water demand in the storage tank 46 may be, for example a liquid level sensor 78 for detecting a predetermined lower level 80 of the liquid in the storage tank 46. The control unit 62 is in this case designed to operate the fresh water supply device 76 in predetermined operating states, e.g., in the initial filling of the wash tanks and thereby supply fresh water to the storage tank 46 when the liquid level in the storage tank is equal to the predetermined lower level 80 or below the predetermined lower level 80. The predetermined lower level 80 in the embodiment depicted here corresponds to the lower switch point of the liquid level sensor 78 which is designed as a level sensor. It is possible to provide for a predetermined amount of fresh water to be supplied in operation of the fresh water supply device 76. Furthermore, it is possible to provide for fresh water to be supplied until reaching a predetermined upper level 81 which is detected by a suitable liquid level sensor. In the embodiment depicted here, the predetermined upper level 81 corresponds to an upper switch point of the level sensor 78 and is thus also detected by the level sensor 78.

A sensor device for determining a fresh water demand in the storage tank 46 may be, for example, in the form of a turbidity sensor 82 for detecting a degree of soiling of the liquid in the storage tank 46. The control unit 62 is in this case designed for operating the fresh water supply device 76 and thereby supplying fresh water to the storage tank 46 when the degree of soiling of the liquid in the storage tank 46 is equal to or greater than a predetermined soiling limit.

The storage tank 46 preferably has an overflow 84 over which liquid flows out when the liquid level in the storage tank is above a predetermined outflow liquid level 86, as illustrated in FIG. 1. An operating state like that depicted in FIG. 1 may occur, for example, in a cleaning operating in which the conveyor dishwasher receives more liquid from the final rinse than is necessary for replenishing the wash tanks, depending on the type of wash ware and the degree of soiling. The predetermined upper level 81 is preferably as high as (as illustrated here) or lower than the predetermined outflow level 86.

In the embodiment illustrated here, the liquid transfer device 54 is the only liquid transfer device for transferring final rinse liquid out of the post-wash zone 14 or out of the final rinse zone 16 into one of the wash zones 10, 12. The baffle 87 shown in FIG. 1 serves to direct liquid that splashes out of the rear wash zone 12, arranged in front of the baffle 87 as seen in direction 8 of conveyance and sent it back into this wash zone 12.

Due to the flow connection of the two wash tanks 18, 20 through the liquid overflow device 68, it is sufficient to provide a liquid transfer device 54 only in the rear wash zone 12. As an alternative, it is possible for a liquid transfer device from the storage tank 46 into the rear wash zone 12 to be provided as well as a liquid transfer from the storage tank 46 into the front wash zone 10 to be provided (not shown), preferably controlled by the control unit 62 independently of one another. In this case, the flow connection 68 between the rear wash zone 12 and the front wash zone 10 may be omitted.

In the above-described conveyor dishwasher 2, sprayed final rinse liquid is advantageously collected in a storage tank, and liquid from the storage tank 46 is supplied to at least one wash zone as a function of a liquid demand. In this way, replenishing of the liquid in the wash tank, i.e., dilution of the liquid in the wash tanks, is performed only when necessary. Any addition of final rinse liquid or fresh water to the wash tanks requires a corresponding addition of detergent to maintain the desired detergent concentration in the wash tanks. Liquid is supplied to the wash tanks only when needed, and the demand for detergent for operation of the conveyor dishwasher 2 is reduced. When a great deal of water is entrained by large dishes, liquid can be supplied to the rear wash tank 20 through the storage tank 46. In this way, a fresh water supply to the rear wash tank, as is customary with known dishwashers, becomes superfluous. This reduces the fresh water consumption by the conveyor dishwasher 2. The final rinse liquid in the storage tank 46 may be used for an initial filling of the wash tanks 18, 20. The fresh water demand by the conveyor dishwasher 2 is reduced in this way.

Depending on the level distance desired between the predetermined upper level and the predetermined lower level in the respective tank 10, 12 or in the storage tank 46, a float switch having a suitable hysteresis range (distance between the upper and lower switch points) may be used for the respective liquid level switches 72, 74, 78. Alternatively, a different number of liquid level sensors having a different function principle may also be used.

The connecting lines have not been shown in the drawings for reasons of simplicity. However, it is self-evident that all the parts of the conveyor dishwasher 2 (e.g., the control unit 62 with the liquid transfer device 54) that cooperate functionally are connected to one another functionally accordingly.

It is to be clearly understood that the above description is intended by way of illustration and example only and is not intended to be taken by way of limitation, and that changes and modifications are possible. Accordingly, other embodiments are within the scope of the following claims

The invention claimed is:

1. A conveyor dishwasher for cleaning wares, comprising:

a conveyor device for conveying wares in a direction of conveyance through at least two zones of the conveyor dishwasher, including at least one wash zone and at least one final rinse zone, the wash zone having spray nozzles, a tank and a pumping device for recirculating wash liquid from the tank to the spray nozzles and spraying wash liquid through the spray nozzles onto wares, the final rinse zone including spray nozzles for spraying final rinse liquid onto wares;

a storage tank for gathering sprayed final rinse liquid;

a liquid transfer device connected for controlling whether liquid is transferred from the storage tank to the wash zone;

at least one sensor device for determining liquid demand in the wash zone; and a control unit configured for automatic operation of the liquid transfer device depending on liquid demand in the wash zone as indicated by the sensor device;

wherein the storage tank has an overflow over which liquid flows from the storage tank when liquid level in the storage tank exceeds a certain outflow level and the overflow is a path separate from a path defined by the liquid transfer device.

2. The conveyor dishwasher according to claim 1 wherein the liquid transfer device includes a pump and a liquid line running from the storage tank to the wash zone and having an outlet to deliver liquid into the tank of the wash zone.

3. The conveyor dishwasher according to claim 1, wherein the at least one sensor device includes a turbidity sensor for detecting a degree of soiling of liquid in the tank of the wash zone, wherein the control unit operates the liquid transfer device when the detected degree of soiling in the tank of the wash zone is equal to or greater than a predetermined degree of soiling.

4. The conveyor dishwasher according to claim 3, wherein the at least one sensor device includes a liquid level sensor for detecting a level of the liquid in the tank of the wash zone, wherein the control unit operates the liquid transfer device when the detected liquid level in the tank of the wash zone is at or below a predetermined lower level.

5. The conveyor dishwasher according to claim 1, wherein the control unit operates the liquid transfer device for supplying liquid from the storage tank to the wash zone during initial filling of the conveyor dishwasher for initial filling of the tank.

6. The conveyor dishwasher according to claim 1 wherein the wash zone is a rear wash zone, the dishwasher further including a front wash zone having a tank from which liquid is delivered to spray nozzles of the front wash zone, wherein the volume of the storage tank is no less than the sum of the volume of the tank of the front wash zone and the volume of the tank of the rear wash zone.

7. The conveyor dishwasher according to claim 1 further comprising a fresh water supply device that supplies fresh water to the storage tank, and at least one sensor device provided for determining fresh water demand in the storage tank, wherein the control unit controls the fresh water supply device as a function of fresh water demand in the storage tank to supply fresh water to the storage tank when there is a demand for fresh water.

8. The conveyor dishwasher according to claim 7, wherein the at least one sensor device comprises a liquid level sensor for detecting a level of liquid in the storage tank, wherein the control unit operates the fresh water supply device and thereby supplies fresh water to the storage tank when the detected liquid level in the storage tank is equal to a predetermined lower level.

9. The conveyor dishwasher according to claim 7, wherein the at least one sensor device comprises a turbidity sensor for use in detecting a degree of soiling of liquid in the storage tank, wherein the control unit operates the fresh water supply device and thereby supplies fresh water to the storage tank when the degree of soiling of liquid in the storage tank is equal to or greater than a predetermined degree of soiling limit.

10. The conveyor dishwasher according to claim 1, wherein a bottom part of the zone in which final rinse liquid is sprayed has a storage tank opening which is connected by flow to the storage tank.

11. A conveyor dishwasher for cleaning wares, comprising:

a conveyor device for conveying wares in a direction of conveyance through multiple zones of the conveyor dishwasher, including a front wash zone, a rear wash zone, a post-wash zone and a final rinse zone, the rear wash zone having spray nozzles, a tank and a pumping device for recirculating wash liquid from the tank to the spray nozzles and spraying wash liquid through the spray nozzles onto wares, the final rinse zone including spray nozzles for spraying final rinse liquid onto wares, the post-wash zone having spray nozzles, a tank and a pumping device for recirculating liquid to the spray nozzles and spraying liquid onto wares, the tank of the post-wash zone arranged to receive final rinse liquid sprayed in the final rinse zone;

a storage tank, separate from the tank of the post-wash zone, for gathering some sprayed final rinse liquid;

a liquid transfer device, including a liquid line running from the storage tank to the rear wash zone and a pump, for controlling whether liquid is transferred from the storage tank to the rear wash zone;

at least one sensor device for determining liquid demand in the rear wash zone; and a control unit configured for automatic operation of the liquid transfer device depending on liquid demand in the rear wash zone as indicated by the sensor device;

wherein walls are provided along a bottom part of the conveyor dishwasher where sprayed final rinse liquid collects, the walls positioned above an opening of the tank of the post-wash zone to permit a liquid level above the opening of the tank of the post-wash zone; and a storage tank opening located in the bottom part and spaced from the tank of the post-wash zone, the storage tank opening connected by flow to the storage tank.

12. The conveyor dishwasher according to claim 11, wherein the at least one sensor device includes a turbidity sensor for detecting a degree of soiling of liquid in the tank of the rear wash zone, wherein the control unit operates the liquid transfer device when the detected degree of soiling in the tank of the rear wash zone is equal to or greater than a predetermined degree of soiling.

13. The conveyor dishwasher according to claim 12, wherein the at least one sensor device includes a liquid level sensor for detecting a level of the liquid in the tank of the rear wash zone, wherein the control unit operates the liquid transfer device when the detected liquid level in the tank of the rear wash zone is at or below a predetermined lower level.

14. The conveyor dishwasher according to claim 11 further comprising a fresh water supply device that supplies fresh water to the storage tank, at least one sensor device provided for determining fresh water demand in the storage tank, wherein the control unit controls the fresh water supply device as a function of fresh water demand in the storage tank to supply fresh water to the storage tank when there is a demand for fresh water.

15. A conveyor dishwasher for cleaning wares, comprising:

a conveyor device for conveying wares in a direction of conveyance through multiple zones of the conveyor dishwasher, including a wash zone, a post-wash zone and a final rinse zone, the wash zone having spray nozzles, a tank and a pumping device for recirculating wash liquid from the tank to the spray nozzles and spraying wash liquid through the spray nozzles onto wares, the final rinse zone including spray nozzles for spraying final rinse liquid onto wares, the post-wash zone having spray nozzles, a tank and a pumping device for recirculating liquid from the post-wash zone tank to the spray nozzles and spraying liquid onto wares, the tank of the post-wash zone arranged to receive final rinse liquid sprayed in the final rinse zone;

a storage tank, separate from the tank of the post-wash zone, for gathering some sprayed final rinse liquid;

a liquid transfer device, including a pump and a liquid line running from the storage tank to the wash zone and having an outlet to deliver liquid to the tank of the wash zone, for controlling whether liquid is transferred from the storage tank to the rear wash zone;

at least one sensor device for determining liquid demand in the rear wash zone; and a control unit configured for automatic operation of the liquid transfer device depending on liquid demand in the rear wash zone as indicated by the sensor device;

wherein the storage tank has an overflow over which liquid flows from the storage tank when liquid level in the storage tank exceeds a certain outflow level and the overflow is a path separate from a path defined by the liquid transfer device.

* * * * *